US006817488B2

(12) United States Patent
Meshberg

(10) Patent No.: US 6,817,488 B2
(45) Date of Patent: Nov. 16, 2004

(54) SPRAY DISPENSING DEVICE WITH NOZZLE CLOSURE

(75) Inventor: Philip Meshberg, Palm Beach, FL (US)

(73) Assignee: Dispensing Patents International LLC, Boynton Beach, FL (US)

( * ) Notice: Subject to any disclaimer, the term of this patent is extended or adjusted under 35 U.S.C. 154(b) by 47 days.

(21) Appl. No.: 10/391,767

(22) Filed: Mar. 20, 2003

(65) Prior Publication Data

US 2003/0213817 A1 Nov. 20, 2003

Related U.S. Application Data

(60) Continuation-in-part of application No. PCT/US01/44806, filed on Nov. 30, 2001, which is a continuation-in-part of application No. 09/726,489, filed on Dec. 1, 2000, now Pat. No. 6,382,463, which is a continuation-in-part of application No. 09/258,945, filed on Mar. 1, 1999, now Pat. No. 6,247,613, which is a continuation-in-part of application No. 08/774,338, filed on Dec. 30, 1996, now Pat. No. 5,875,932, which is a division of application No. 08/419,499, filed on Apr. 10, 1995, now Pat. No. 5,620,113.

(60) Provisional application No. 60/365,548, filed on Mar. 20, 2002.

(51) Int. Cl.[7] ..... B65D 83/00

(52) U.S. Cl. ..... 222/153.11; 222/153.14; 222/321.7; 222/383.1; 222/402.11

(58) Field of Search ..... 222/153.11, 153.14, 222/321.7, 321.9, 383.1, 402.11

(56) References Cited

U.S. PATENT DOCUMENTS 3,904,088 A * 9/1975 Milbourne, Sr. ..... 222/402.11
4,506,805 A * 3/1985 Marcon ..... 222/153.13
5,158,211 A * 10/1992 Meshberg ..... 222/153.06
5,158,233 A * 10/1992 Foster et al. ..... 239/333
5,603,434 A * 2/1997 von Schuckmann ... 222/153.14
5,738,251 A * 4/1998 Schuckmann ..... 222/153.14

* cited by examiner

*Primary Examiner*—Joseph A. Kaufman
(74) *Attorney, Agent, or Firm*—Kenyon & Kenyon

(57) ABSTRACT

In accordance with embodiments of the present invention, an apparatus includes an actuator with a spray nozzle and an opening adjacent the spray nozzle. The actuator dispenses spray through an orifice in the spray nozzle when the actuator is depressed to operate a pump or an aerosol valve. A wall including the spray opening at least partially surrounds the actuator and the spray nozzle is aligned with the spray opening during dispensing whereby spray exiting the spray nozzle orifice passes through the spray opening. Also included is a nozzle closure, with a first projection and a second projection. The first projection, forming a sealing rim with an inner recess, fits into the opening adjacent the spray nozzle thereby sealing the spray nozzle. The nozzle closure has a hinge allowing pivotal movement of the nozzle closure from a closed position, at which the first projection fits into the opening in the wall adjacent the spray nozzle and the nozzle closure closes the spray opening, to an open position, where the spray opening is open to permit the spray to pass through the spray opening when the actuator is depressed. The second projection fits within the inner recess of the first projection, and, when the nozzle closure is in a closed position, the second projection sealingly engages the orifice of the spray nozzle and displaces any spray deposits that may have accumulated therein. In another embodiment, a third projection may also be provided on the nozzle closure. The third projection may be located on the closure between the hinge and the first projection and may fit in a recess in the actuator, engaging the recess when the nozzle closure is in a closed position and preventing actuation of the actuator when the nozzle closure is closed.

18 Claims, 13 Drawing Sheets

SPRAY DISPENSING DEVICE WITH NOZZLE CLOSURE

CLAIM FOR PRIORITY/CROSS REFERENCE TO RELATED APPLICATIONS

This non-provisional application claims the benefit of U.S. Provisional Application No. 60/365,548, filed Mar. 20, 2002, and is a continuation-in-part of PCT Application Ser. No. PCT/US01/44806 (filed Nov. 30, 2001), now WIPO International Publication No. WO 02/43872 A2 (published Jun. 6, 2002), which is a continuation-in-part of U.S. patent application Ser. No. 09/726,489 (filed Dec. 1, 2000), now U.S. Pat. No. 6,382,463 B2 (issued May 7, 2002), which is a continuation-in-part of U.S. patent application Ser. No. 09/258,945 (filed Mar. 1, 1999), now U.S. Pat. No. 6,247, 613 B1 (issued Jun. 19, 2001), which is a continuation-in-part of U.S. patent application Ser. No. 08/774,338 (filed Dec. 30, 1996), now U.S. Pat. No. 5,875,932 (issued Mar. 2, 1999), which is a division of U.S. patent application Ser. No. 08/419,499 (filed Apr. 10, 1995), now U.S. Pat. No. 5,620, 113 (issued Apr. 15, 1997), which are all incorporated by reference herein in their entirety.

BACKGROUND OF THE INVENTION

1. Field of the Invention

The present invention relates to a spray dispensing device with a closure for the spray nozzle. In particular, the present invention relates to a nozzle closure which includes structure to provide a seal for a dispensing actuator to prevent air or contaminants from causing clogging, which may lock the dispensing actuator when not in use and which may provide a measure of child-resistance. The present invention may also include structure to provide evidence of tampering with the nozzle closure.

2. Description of the Prior Art

In U.S. Pat. No. 5,158,211 (the "'211 patent"), issued Oct. 27, 1992, a mechanism is disclosed for sealing the outlet nozzle of a spray actuator when the dispenser is not in use to prevent accidental discharge of liquid. The mechanism for sealing the dispensing orifice prevents drying of the contents of the container in the spray orifice, thereby preventing clogging of the spray orifice. However, the device disclosed in the '211 patent requires that the actuator be rotated to a non-dispensing position for the sealing device to seal the orifice. Furthermore, this device has a removable tab for the dispensing position. Such a removable tab leaves an opening in the actuator shroud which can be the repository for dirt or dust, which can interfere with operation of the actuator or nozzle.

In the applications listed above, embodiments of nozzle closures which are mounted for pivoting movement from a closed to an open position are used with a spray dispensing device. In the open position, the nozzle closure moves away from the spray nozzle on an actuator and a spray opening in a surrounding wall, allowing fluid to dispensed through the nozzle, as the actuator is depressed. In the closed position, the nozzle closure pivots into a position where a projection enters at least partially into the spray nozzle. The projection acts to seal the spray nozzle against air, thereby preventing drying of any fluid in the nozzle and reducing the chance that the spray nozzle will become clogged. The nozzle closure in these embodiments also serves to provide resistance against depression of the actuator, to prevent accidental discharge from the spray nozzle.

Although, these embodiments have proven effective, in some cases the projection does not provide sufficient resistance against accidental discharge, for example, in the case where the source of material for the spray nozzle is an aerosol valve, or, in the case of undesired actuation by children. Thus, there is a need for a better nozzle closure which more positively prevents accidental discharge.

SUMMARY OF THE INVENTION

In accordance with embodiments of the present invention, an apparatus includes an actuator with a spray nozzle and an opening adjacent the spray nozzle. The actuator dispenses spray through an orifice in the spray nozzle when the actuator is depressed to operate a pump or an aerosol valve. A wall including the spray opening at least partially surrounds the actuator and the spray nozzle is aligned with the spray opening during dispensing whereby spray exiting the spray nozzle orifice passes through the spray opening. Also included is a nozzle closure, with a first projection and a second projection. The first projection, forming a sealing rim with an inner recess, fits into the opening adjacent the spray nozzle thereby sealing the spray nozzle. The nozzle closure has a hinge allowing pivotal movement of the nozzle closure from a closed position, at which the first projection fits into the opening in the wall adjacent the spray nozzle and the nozzle closure closes the spray opening, to an open position, where the spray opening is open to permit the spray to pass through the spray opening when the actuator is depressed. The second projection fits within the inner recess of the first projection, and, when the nozzle closure is in a closed position, the second projection sealingly engages the orifice of the spray nozzle and displaces any spray deposits that may have accumulated therein. In another embodiment, a third projection may also be provided on the nozzle closure. The third projection may be located on the closure between the hinge and the first projection and may fit in a recess in the actuator, engaging the recess when the nozzle closure is in a closed position and preventing actuation of the actuator when the nozzle closure is closed.

DETAILED DESCRIPTION

Figure 14:
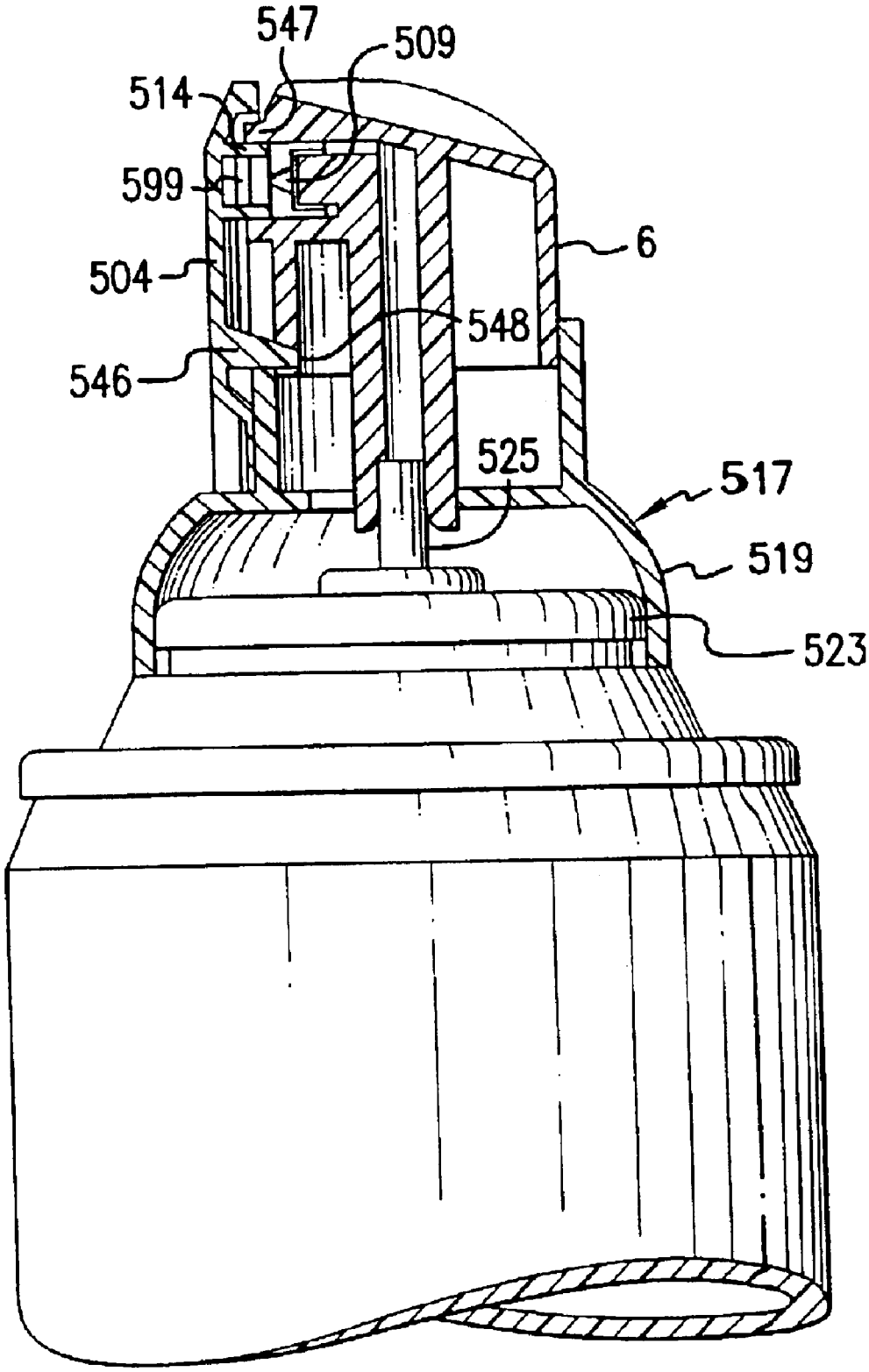
FIG. 14 is a side cross-sectional view of the embodiment of FIG. 13 in a closed position.

FIG. 14 show a container 402 with a mounting cap 417 which includes a first embodiment of the nozzle closure of the present invention. Details of the container 402 and mounting cap are described in U.S. Pat. No. 5,875,932 and 5,620,113, the disclosures of which patents are incorporated herein by reference. The mounting cap 417 shown in FIGS. 1–4 is particularly effective in ensuring a leakproof and easy-to-assemble mounting of pump 12 onto container portion 402 without the need for complicated molding of container portion 402.

Mounting cap 417 includes an interior piston portion 480, which slides in and seals against an interior sealing surface of container portion 402. Actuator 6 includes a downwardly extending projection 7, In fluid communication with spray nozzle 9, which sealingly engages an upwardly projecting stem 8 of pump 12.

Container portion 402 also includes, at its upper end, an angled snap rim extending around the entire circumference of container portion 402. The snap rim includes a lower snap surface, and mounting cap 417 includes an exterior snap flange 486 which is used to secure and seal mounting cap 417 to container portion 402. The container portion 402 may include a bottom closure 217 with an inner piston portion 200 and an exterior snap flange 286.

Figure 2:
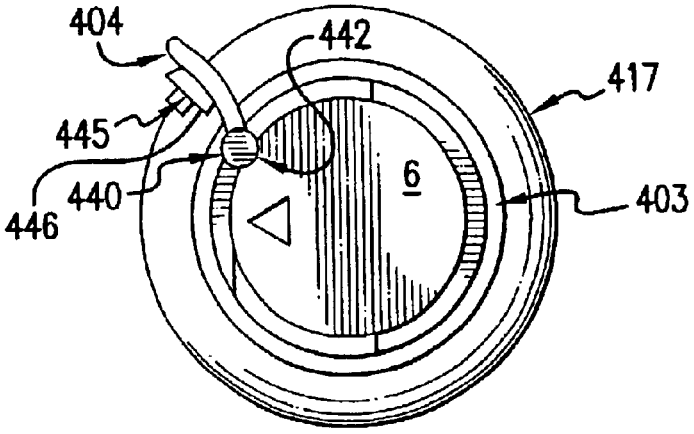
FIG. 2 is a top view of the actuator and mounting cap of the embodiment of FIG. 1.
Figure 3:
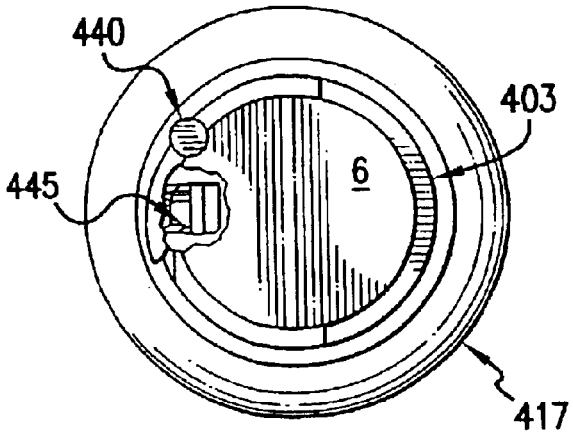
FIG. 3 is a partial cross-section of the view of FIG. 2.
Figure 4:
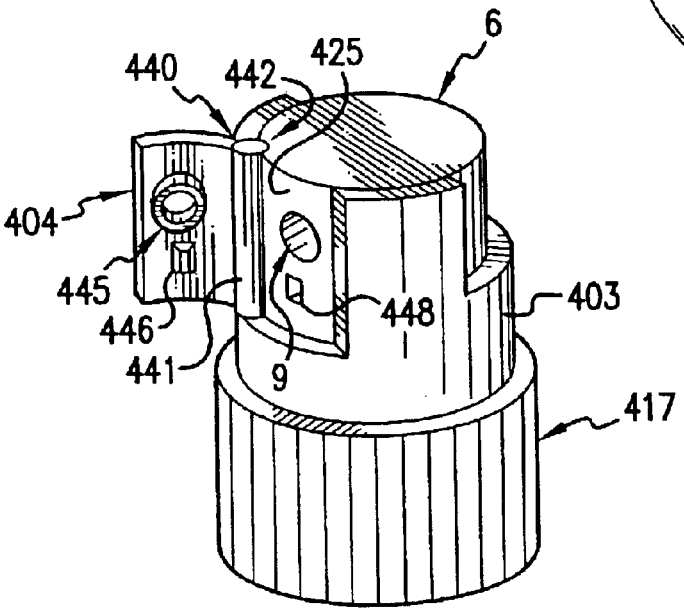
FIG. 4 is a perspective view of the actuator and mounting cap of the embodiment of FIG. 1.
Figure 5:
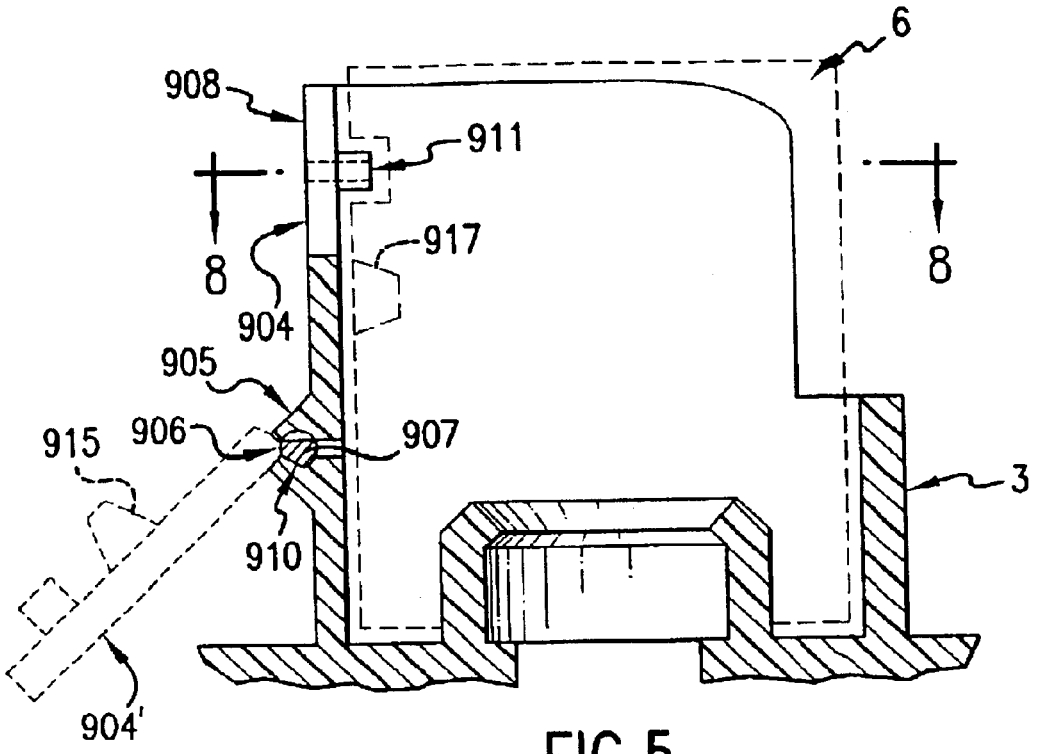
FIG. 5 is a cross-sectional view of the upper end of a container, showing two positions of a second embodiment of a nozzle closure of the present invention.
Figure 6:
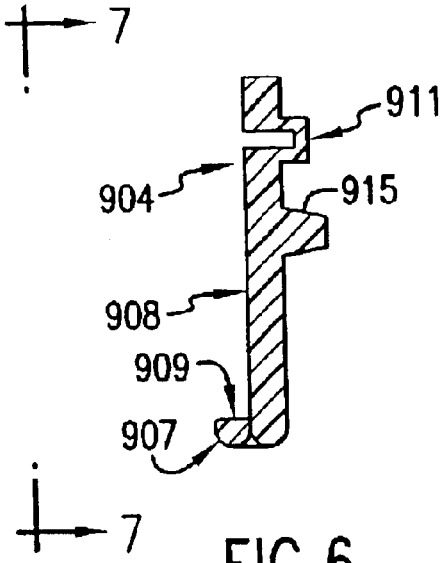
FIG. 6 is a cross-sectional view through line 6-6 of FIG. 7, of the spray nozzle closure of the embodiment of FIG. 5.
Figure 7:
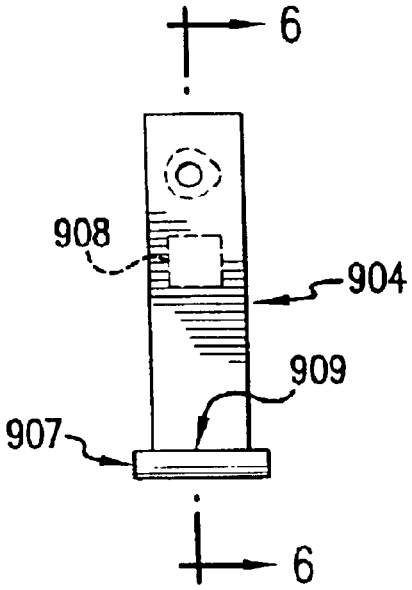
FIG. 7 is a front view of the spray nozzle closure of the embodiment of FIG. 5.
Figure 8:
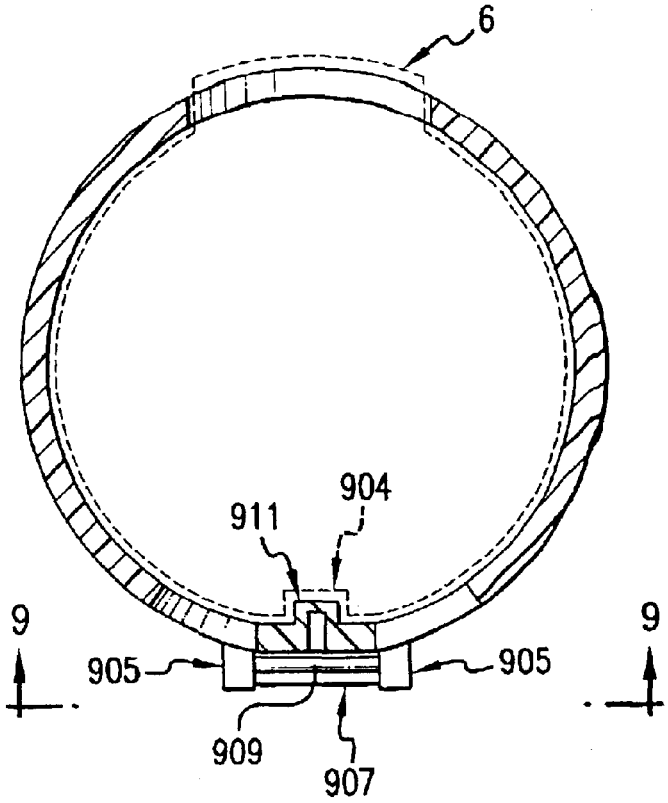
FIG. 8 is a top cross-sectional view through line 8-8 of the spray nozzle closure of the embodiment of FIG. 5.
Figure 9:
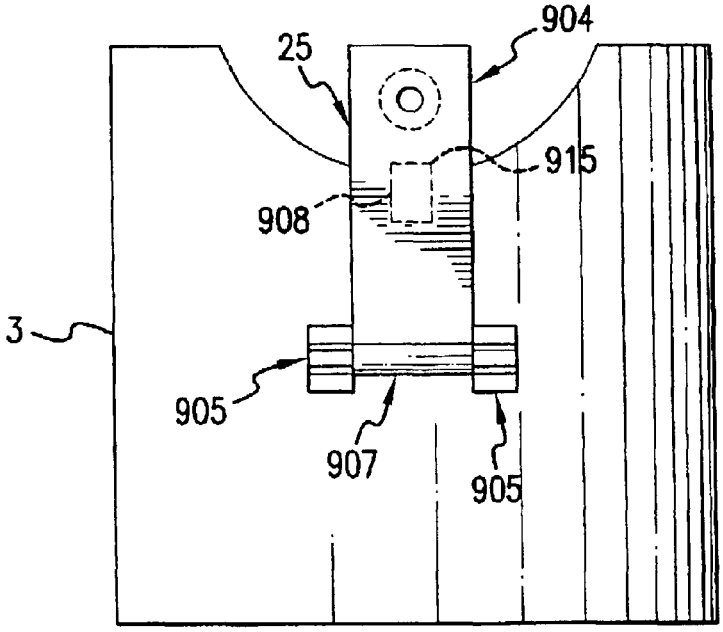
FIG. 9 is a front view of the of the upper end of a container, showing the spray nozzle closure of the embodiment of FIG. 5.

FIGS. 2–4 show the details of the first embodiment of spray nozzle closure for sealing the nozzle 9 on actuator 6. An upstanding wall 403 on mounting cap 417 has mounted thereon, by way of a vertical hinge 440, a sealing finger 404. Hinge 440 can be of any known type, including a molded pin on upstanding wall 403 fitting within a hole in the cylindrical portion 441 of sealing finger 404. Through the mounting described above, since it is part of the mounting cap 417, wall 403 is mounted to container portion 402. This arrangement allows the sealing finger 404 to be detachably connected to the wall 403, which remains fixed to container portion 402. Cylindrical portion 441 of sealing finger 404 fits within a semi-circular recess 442 in actuator 6. The fit between cylindrical portion 441 and recess 442 ensures that actuator 6 may not be rotated such that spray nozzle 9 is not aligned with spray opening 425 in upstanding wall 403. Sealing finger 404 also includes a tapered projection 446. Actuator 6 has a matching recess 448.

Sealing finger 404, when it is desired to dispense fluid, in the form of spray, from container portion 402, is pivoted away from the spray nozzle 9, to the position shown in FIGS. 2 and 4. Thereafter, the actuator is depressed, and spray exits the spray nozzle 9 through spray opening 425. After dispensing, the sealing finger 404 is pivoted towards spray nozzle 9, so that a projection in the form of an annular sealing rim 445 engages in an opening adjacent the spray nozzle 9. This engagement seals the nozzle 9 from the encroachment of air or other debris into spray nozzle 9, thereby preventing clogging of the nozzle 9 between dispensing strokes. In the closed position, shown in FIG. 3, the sealing finger 404 completely covers spray opening 425. In this closed position the engagement of projection 446 with recess 448 acts to prevent the actuator 6 from being depressed, thereby locking the actuator 6 against accidental discharge. In this embodiment the hinge rotates about an axis parallel to the direction of actuation.

In order to advantageously impart a measure of child resistance to the operation of the nozzle closure, a degree of opening resistance can be provided for the sealing finger 404. A child may be required to use both hands to overcome the opening resistance and operate the sealing finger 404 from the closed position to the open position, e.g., by grasping container portion 402 in one hand while operating the sealing finger 404 with the other hand. For example, in order to operate the sealing finger 404 from the closed position to the open position, a predetermined amount of force can be required to overcome the friction developed between the contacting edges of the sealing finger 404 and the wall 403. In this case, a press fit can be created, between the sealing finger 404 and the wall 403, by slightly oversizing the sealing finger 404 relative to the spray opening 425. In another example, a predetermined amount of force can be required to overcome the friction developed between the contacting edges of the annular sealing rim 445 and the actuator 6. In this case, a press fit can be created between the annular sealing rim 445 and the actuator 6 by slightly oversizing the annular sealing rim 445 relative to the opening adjacent the spray nozzle 9. And, in a further example, a predetermined amount of force can be required to overcome the friction developed between the contacting edges of the projection 446 and actuator 6. In this case, a press fit can be created between the projection 446 and actuator 6 by slightly oversizing the projection 446 relative to the recess 448. Thus, a range of opening resistances can easily be created by varying the relative dimensions of the appropriate combinations of components.

FIGS. 5–9 show the features of a second embodiment of a nozzle closure with a spray orifice sealing device of the present invention. Upstanding wall portion 3 of a mounting cap or integral container has mounted thereon, on opposite sides of the spray opening 25, a bearing in the form of lugs 905. Lugs 905 have a front opening 906 through which the sealing finger 904 lower end may be inserted. Sealing finger 904 includes a hinge 907 mounted on a front surface 908 of sealing finger 904. This arrangement allows the sealing finger 904 to be detachably connected to the wall 3. Hinge 907 includes a flattened surface 909, and other than flattened surface 909, is cylindrical in shape. Lugs 905 define an opening which is cylindrical in shape, except for a flattened section 910. Hinge 907 therefore rotates in the opening in lugs 905, but snap-locks into the position shown as 904 when the flattened surface 909 interacts with flattened section 910. In this embodiment the hinge rotates about an axis perpendicular to the direction of actuation. Sealing finger 904 includes a closure projection 911 which is shaped so as to sealingly fit within the opening surrounding the spray orifice on the actuator. Accordingly, in the position shown as 904 in FIG. 5, the closure portion 911 projects into, and seals, the opening around the spray orifice, preventing air from entering the spray orifice and drying out the liquid in the dispenser. This sealing prevents any potential clogging of the spray orifice. In the position shown as 904' in FIG. 5, the sealing finger 904 is snapped into a position away from the spray orifice, where the sealing finger 904 will not interfere with the spray from the spray orifice. At the same time the engagement of a projection 915 with a recess 917 acts to prevent the actuator 6 from being depressed, thereby locking the actuator 6 against accidental discharge.

Sealing finger 904 is designed so that front surface 908 lies flush with the outer surface of upstanding wall 3. In addition, sealing finger 904 is easily inserted into lugs 905, thereby allowing easy interchangeability of sealing finger 904 onto upstanding wall 3, so that sealing fingers 904 having different colors, different closure portion 911 sizes and shapes, etc., may be placed on upstanding wall 3. Furthermore, sealing finger 904 completely fills the spray opening 25 when closure portion 911 is engaged with the spray orifice opening on the actuator so that dirt, sand, or lint does not dog spray opening 25. As with the embodiment of FIGS. 1–4, the embodiment of FIGS. 5–9, as noted above, also locks the actuator 6 against accidental discharge, upon insertion of projection 915 into recess 917. Of course, a degree of opening resistance can be provided for sealing finger 904 in a manner similar to that discussed above for sealing finger 404 in order to impart a measure of child resistance to the present invention.

Figure 1:
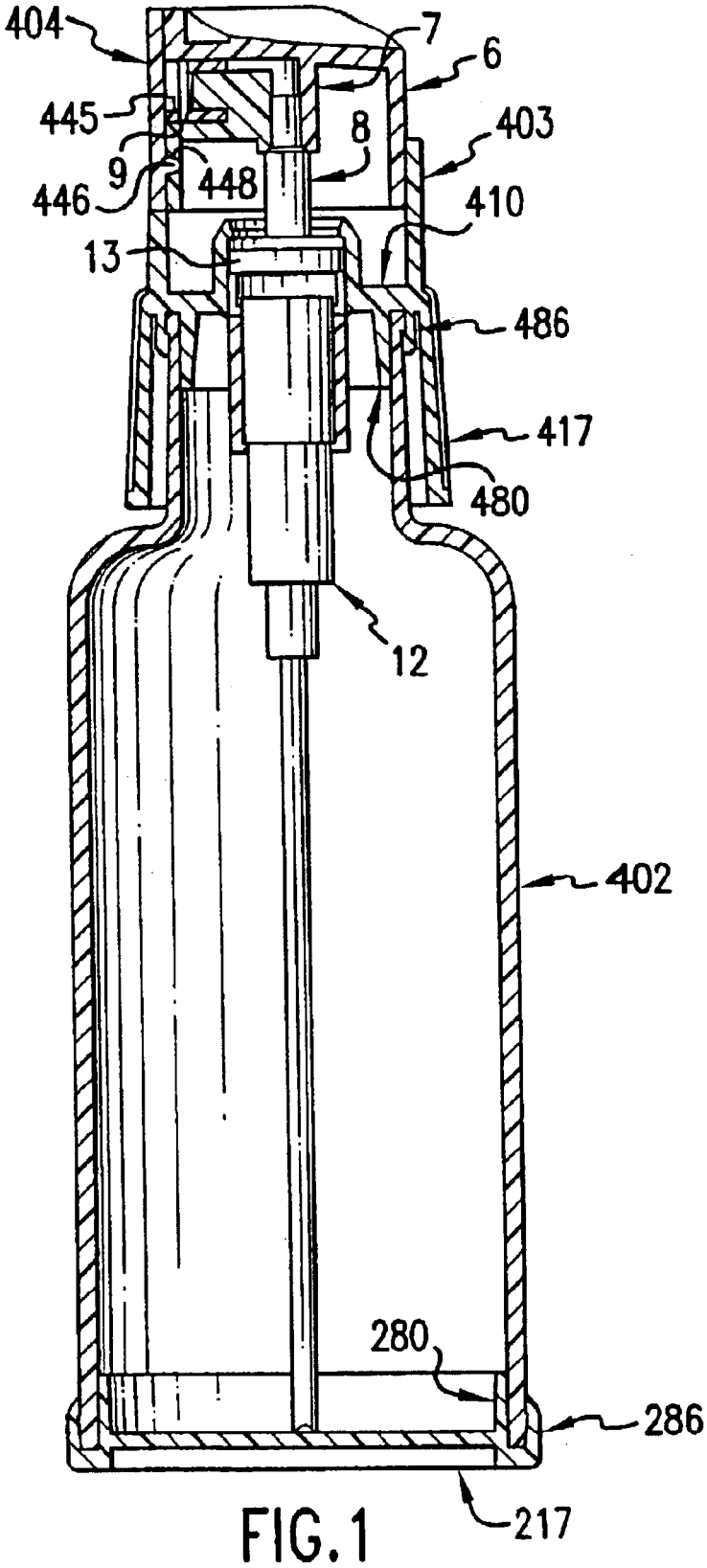
FIG. 1 is a cross-sectional view of an assembled package including a first embodiment of a nozzle closure of the present invention.
Figure 10:
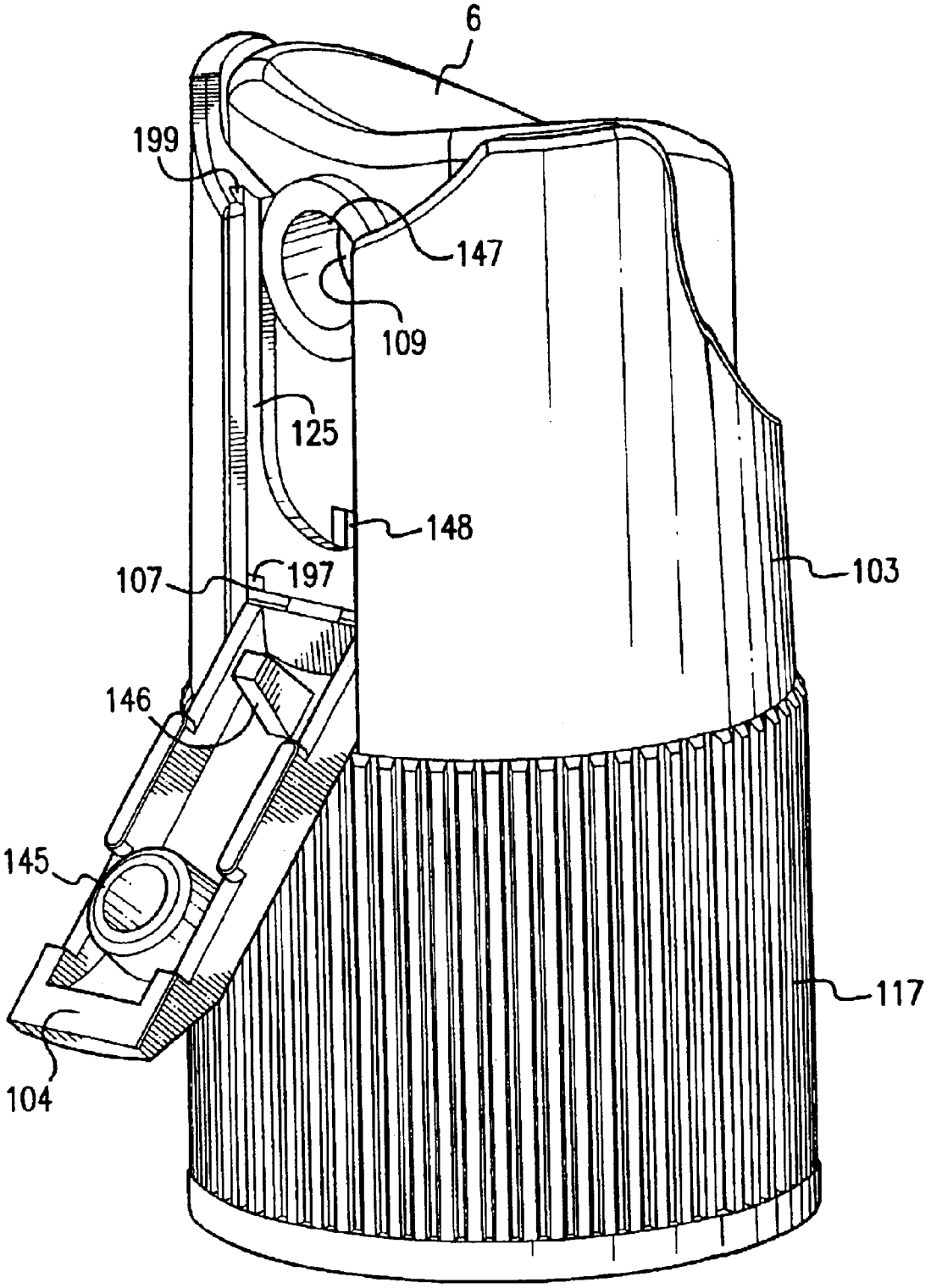
FIG. 10 is a perspective view of a third embodiment of a nozzle closure of the present invention, in an open position.
Figure 11:
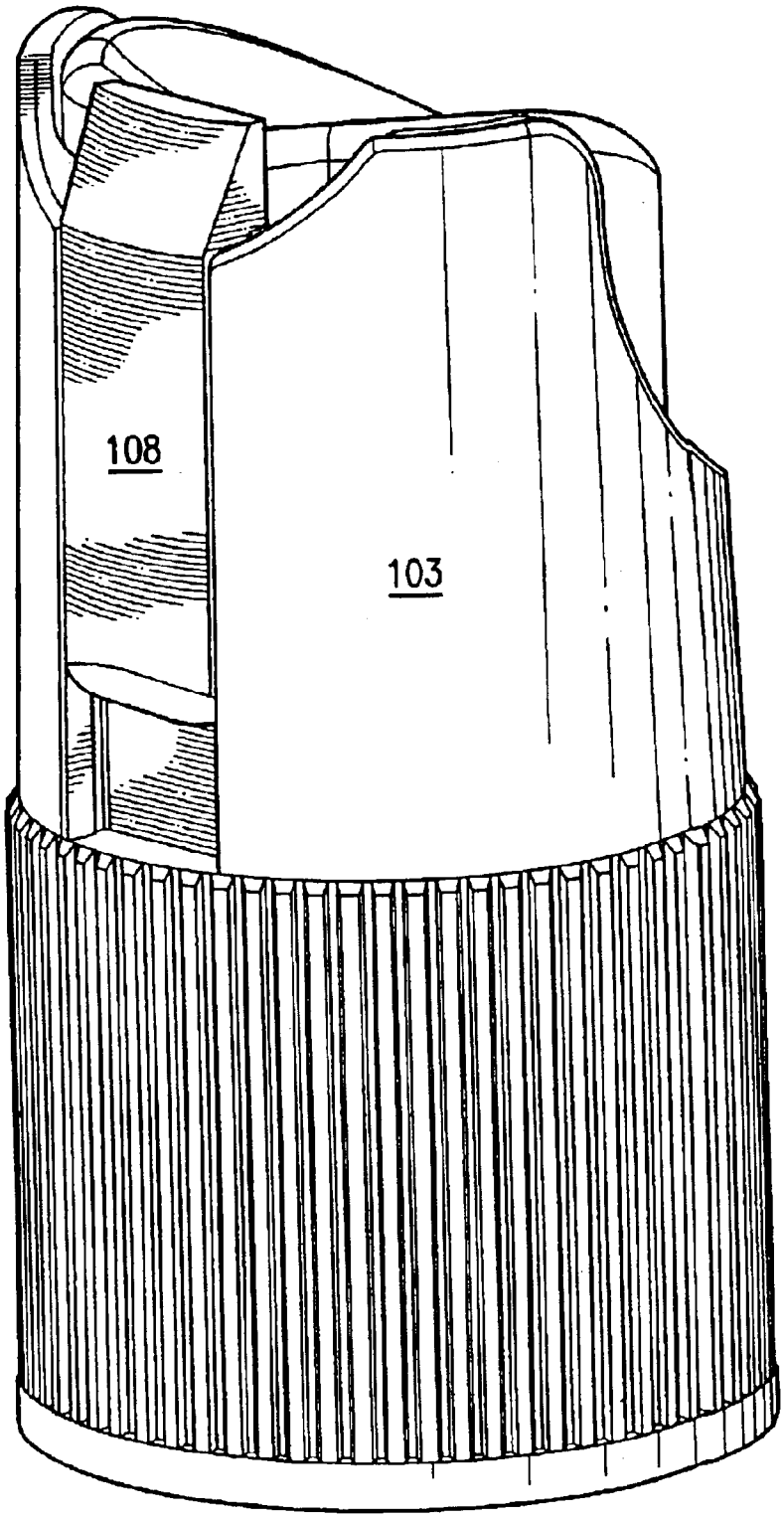
FIG. 11 is a perspective view of the embodiment of FIG. 11, in a closed position.
Figure 12:
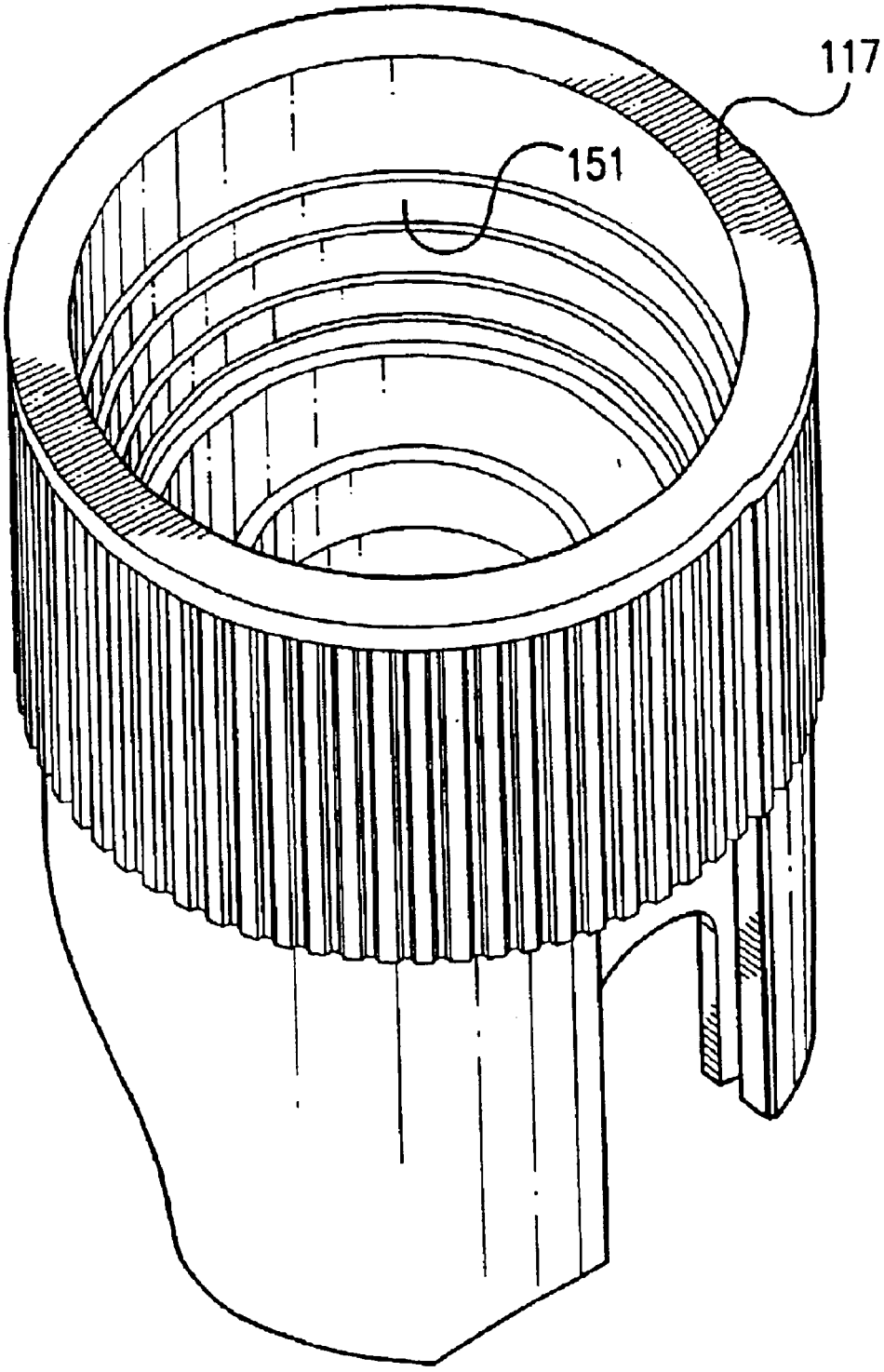
FIG. 12 is a perspective view of the embodiment of FIG. 10, from below showing an internal thread.

FIGS. 10–11 are perspective views of a third embodiment which is a variation of the embodiment of FIGS. 5–9. Upstanding wall portion 103 of a mounting cap 117 includes a spray opening 125. This mounting cap 117 may be mounted on a container as shown in FIG. 1. Alternatively, mounting cap 117 may be a screw-on cap as shown in FIG. 12. As illustrated the inside portion of the cap 117 may contain threads 151 for screwing onto a container having a threaded neck.

Sealing finger 104 includes a horizontal hinge 107 disposed at the base of a slots 199 formed in wall portion 103 at opposing sides of opening 125. A bump 197, past which hinge 47 must be pressed prevent the hinge from coming out of the slot once it is pushed into place. Hinge 107 therefore allows sealing finger 104 to rotate relative to wall portion 103 from an open position (FIG. 10) to a closed position (FIG. 11). Sealing finger 104 includes a projection in the form of an annular sealing rim 145 which is shaped so as to sealingly fit within the opening 147 surrounding the spray orifice 109 on the actuator 6. Sealing finger 104 also includes a tapered projection 146 which is shaped so as to tightly fit within an opening 148 on the actuator 6 to positively prevent accidental discharge when the sealing finger 104 is in the closed position.

Accordingly, in the position shown in FIG. 11, the annular sealing rim 145 projects into, and seals, the opening around the spray orifice 109, preventing air from entering the spray orifice 109 and drying out the liquid in the dispenser. This sealing prevents any potential clogging of the spray orifice 109. At the same time, in the position shown in FIG. 10, the sealing finger 104 is moved to a position away from the spray orifice 109, where the sealing finger 104 will not interfere with the spray from the spray orifice and does not block the spray opening 125.

Sealing finger 104 is designed so that front surface 108 lies flush with the outer surface of upstanding wall 103. As a result of the insertion of the hinge of the sealing finger into slots, sealing finger 104 is easily inserted into, and removed from, the mounting cap or cap 117, thereby allowing easy interchangeability of sealing finger 104, so that sealing fingers 104 having different colors, different annular sealing rim 145 sizes and shapes, etc., may be placed on the mounting cap 117. This arrangement allows the sealing finger 104 to be detachably connected to the wall 103. Furthermore, sealing finger 104 completely fills the spray opening 125 when annular sealing rim 145 is engaged with the spray orifice 109 opening on the actuator 6 so that dirt, sand, or lint does not clog spray opening 125.

As noted above, the embodiment of FIGS. 10–12 also includes a feature for positively locking the actuator 6 against accidental discharge. Sealing finger 104 includes a locking projection 146 which fits in a recess 148 of actuator 6 when the sealing finger 104 is in the closed position (FIG. 11). The locking projection 146 in this position therefore prevents the actuator 6 from being depressed downwardly, thereby preventing accidental discharge from the spray orifice 109. In the open positions shown in FIGS. 10, the locking projection 146 moves away from the actuator 6, thereby allowing depression of the actuator 6 and spray dispensing through the spray orifice 109. Of course, a degree of opening resistance can be provided for sealing finger 104 in a manner similar to that discussed above for sealing finger 404 in order to impart a measure of child resistance to the present invention.

Figure 15A:
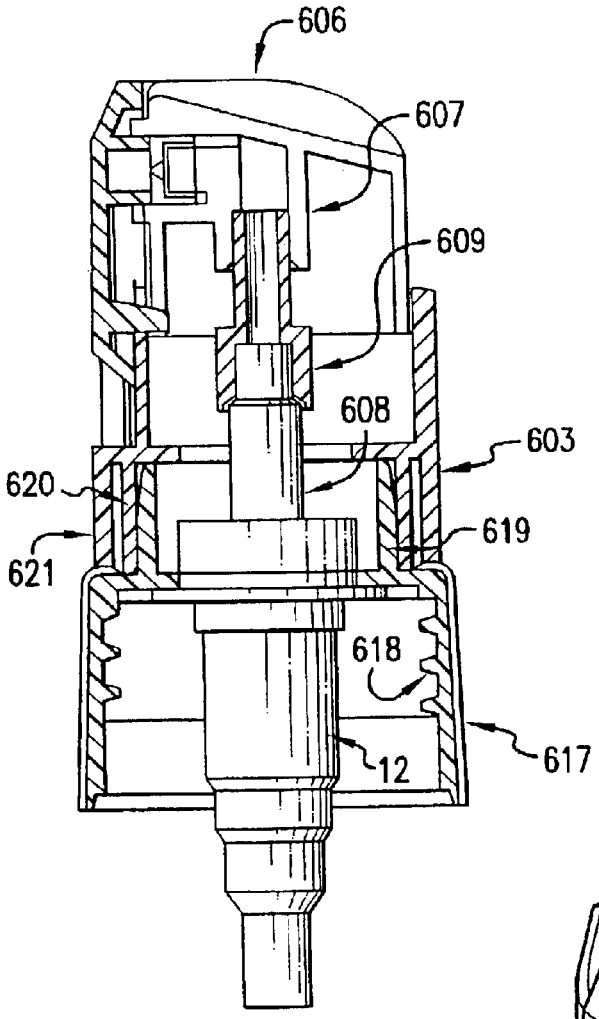
FIG. 15A is a cut-away perspective view of a variation of the embodiment of FIGS. 10–12, showing an actuator extension.

FIG. 15A is a cross-sectional view of a variation of the embodiment of FIGS. 10–12. An extension 609 can be mounted on the upwardly projecting stem 608 of pump 12 to sealingly engage the downwardly extending member 607 of actuator 606 and the upwardly projecting stem 608. The extension 609 can be made of different lengths to adapt the actuator 606 for use with various pre-existing containers, pumps, and pump stems not originally designed for use with the present invention. The mounting cap 617 includes a rim 619 extending around the entire circumference of the upper end of the mounting cap 617. The wall 603 includes an interior flange 620 and an exterior flange 621, both the interior flange 620 and the exterior flange 621 extend around the entire circumference of the lower end of the wall 603. A press fit can be established between rim 619 and interior flange 620 to secure the wall 603 to the mounting cap 617. The inside portion of mounting cap 617 may include interior threads 618 to secure the mounting cap 617 to the container.

The embodiment of FIG. 1 is directed to a pump. However, the actuators with spray nozzles described herein may also be used with aerosol valves. A specific example of an embodiment of the present invention used with an aerosol valve is shown in FIGS. 13 and 14.

Figure 13:
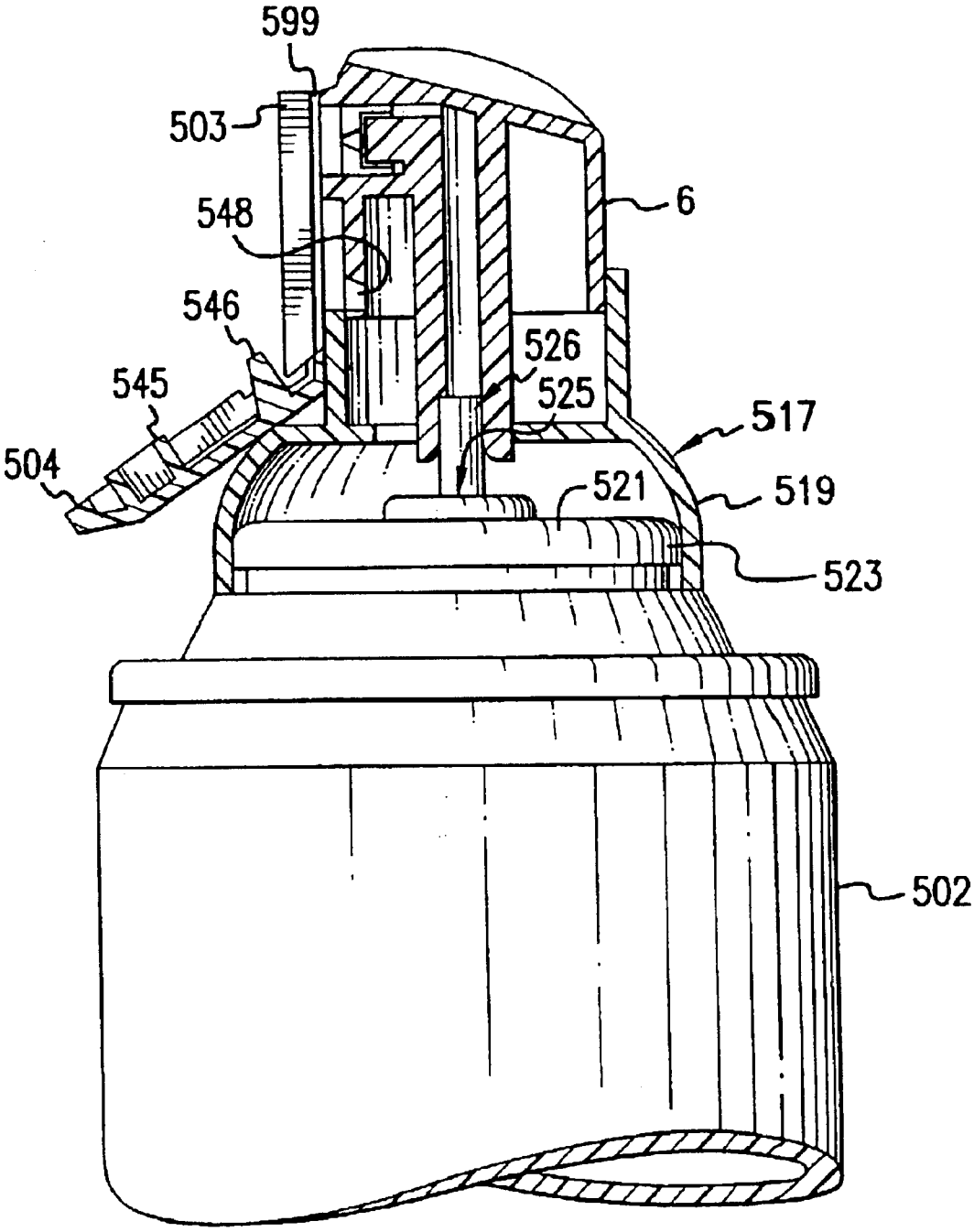
FIG. 13 is a side cross-sectional view of a fourth embodiment of a nozzle closure of the present invention, in an open position.

FIGS. 13 and 14 show an aerosol container 502 with a mounting cap 517 which includes an embodiment of the nozzle closure of the present invention of the general nature shown in FIGS. 10 and 11. The mounting cap 517 shown in FIGS. 13 and 14 includes a cylindrical skirt 519 which engages a beaded rim 523 of a mounting cup 521, at the top of the aerosol container 502, with a press fit attaching mounting cap 517, and with it wall 503, to container 502.

Container 502 includes, at its upper end, a beaded rim 523 extending around its entire circumference. In conventional fashion, this is part of mounting cup 521. Mounting cup 521 contains an aerosol valve 525 with an upwardly projecting stem 526, and has, as its purpose, mounting the aerosol valve 525 and stem 526 to the top of container 502.

The construction and operation of sealing finger 504 with its sealing rim 545 and its tapered projection 546 is as described in connection with FIGS. 10 and 11. Sealing finger 504 is shown in the open position in FIG. 13 and in the closed position in FIG. 14.

The slots 599 in wall 503 by means of which the hinge of the sealing finger 504 is retained are visible, as is the recess 548 into which projection 546 is inserted when the sealing finger 504 is closed. The manner in which sealing rim 545 fits into the recess 547 surrounding the nozzle is shown in FIG. 14. In this embodiment, with an aerosol valve, accidental actuation is more of a danger and the positive locking effect of projection 546 fitting into matching recess 548 is even more important. Of course, a degree of opening resistance can be provided for sealing finger 504 in a manner similar to that discussed above for sealing finger 404 in order to impart a measure of child resistance to the present invention.

Figure 15B:
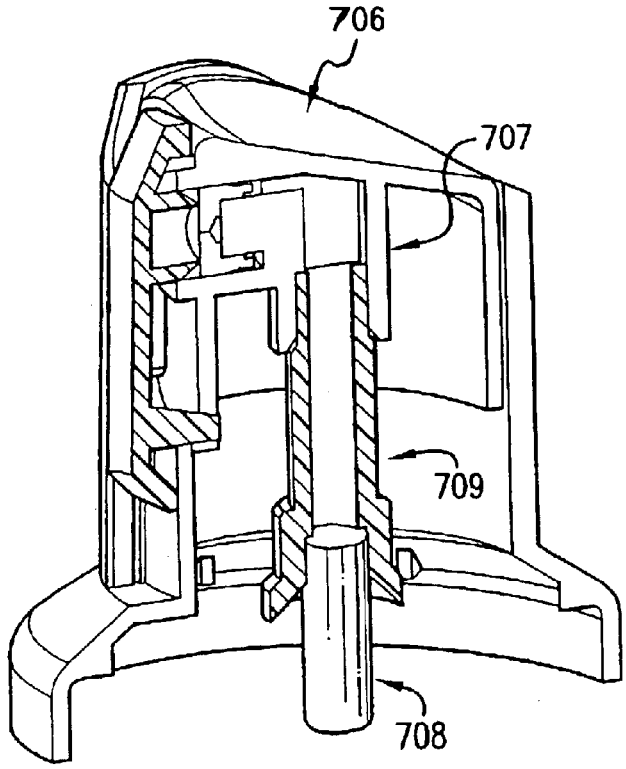
FIG. 15B is a cut-away perspective view, in partial cross-section, of a variation of the embodiment of FIGS. 13–14, showing an actuator extension.

FIG. 15B is a cut-away perspective view, partially in cross-section, of a variation of the embodiment of FIGS. 13–14. An extension 709 can be mounted on the upwardly projecting stem 708 to sealingly engage the downwardly extending projection 707 of actuator 706 and the upwardly projecting stem 708. The extension 709 can be made of different lengths to adapt the actuator 706 for use with various pre-existing containers, aerosol valves, and valve stems not originally designed for use with the present invention.

Figure 16:
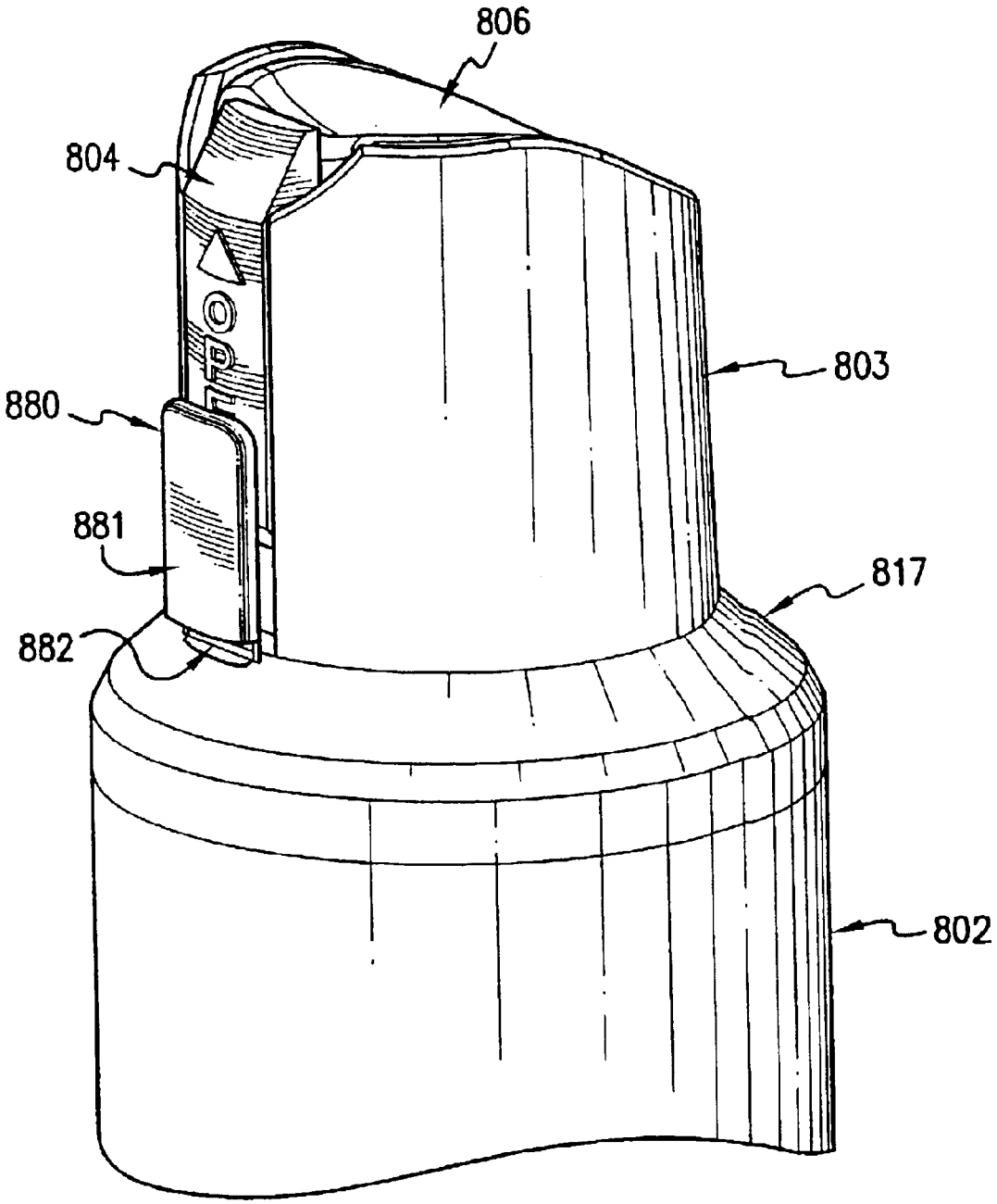
FIG. 16 is a perspective view of a variation of the embodiment of FIGS. 13–14, showing a removable tab.

FIG. 16 is a perspective view of a variation of the embodiment of FIGS. 13–14, showing a removable tab. FIG. 16 shows an aerosol container 802 with a mounting cap 817 including upwardly extending wall 803, actuator 806, and an embodiment of the nozzle closure of the present invention of the general nature shown in FIGS. 13–14. The construction and operation of sealing finger 804 is as described in connection with FIGS. 13–14, and is shown in the closed position in FIG. 16. Removable tab 880 can be seen extending upwardly from mounting cap 817 in a position opposing the pivotal movement of sealing finger 804 from the closed position (e.g., FIGS. 16 and 14) to the open position (e.g., FIG. 13). Removable tab 880 may include a tab portion 881 which is approximately as thick as wall 803, and a frangible portion 882 that is thinner. Before operating actuator 806 for the first time, removable tab 880 must be broken away from mounting cap 817. For example, a user may remove the removable tab 880 by grasping aerosol container 802 in one hand and operating the sealing finger 804 from the closed position to the open position with the other hand, thereby breaking removable tab 880. Or, the user may simply grasp aerosol container 802 in one hand and remove the removable tab 880 with the other hand. In a more skillful example, a dexterous user may grasp aerosol container 802 with one hand and either operate sealing finger 804 or break away removable tab 880 with the index or middle finger of his grasping hand. Although the removable tab 880 is shown in connection with a variation of the embodiment of FIGS. 13–14, it can also be employed with the other embodiments, such as that of FIGS. 10–12.

Figure 17:
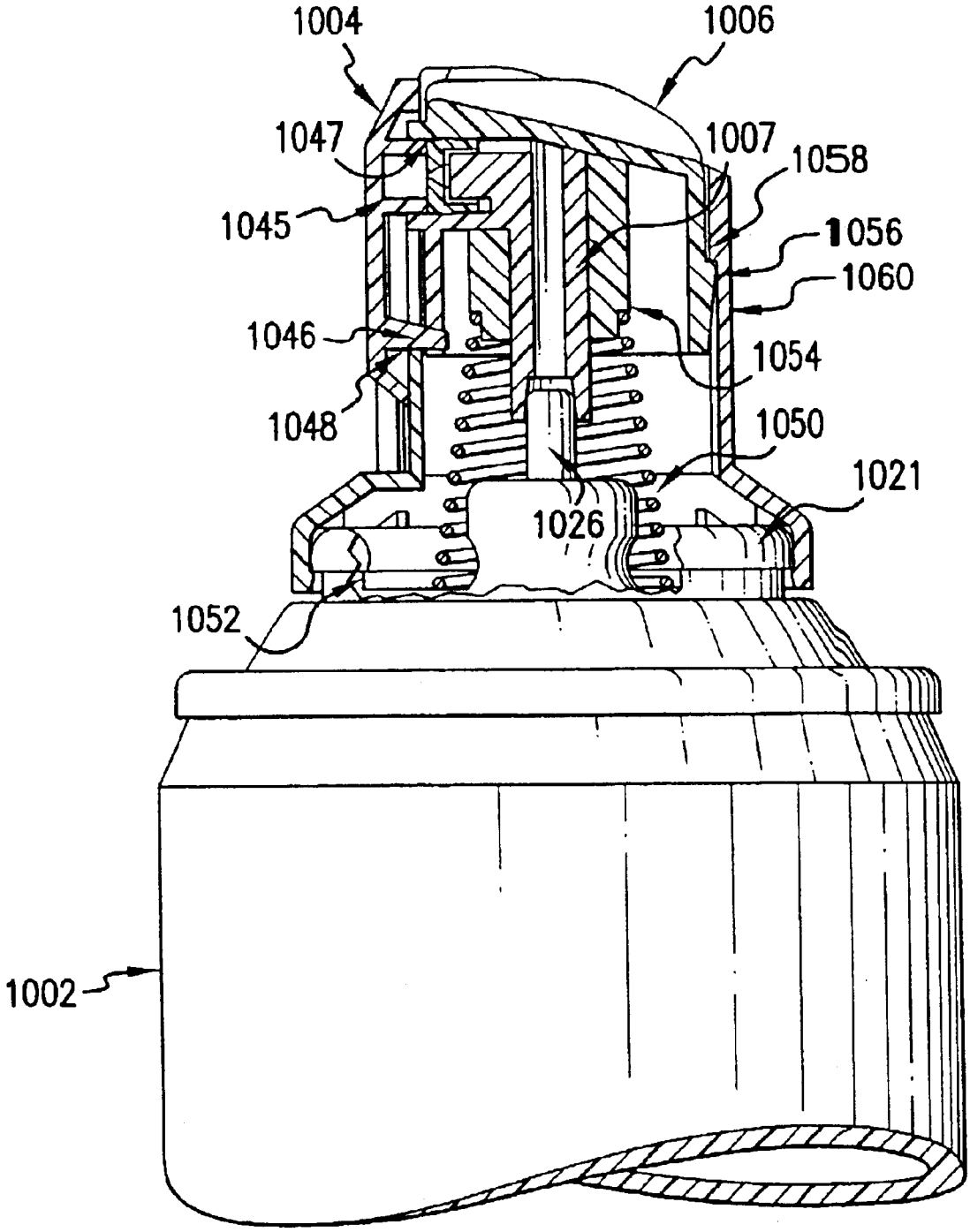
FIG. 17 is a side cross-sectional view of a further embodiment of the present invention.

FIG. 17 illustrates a further embodiment of the present invention for use with a pressurized dispenser. In such dispensers, the container 1002 is typically cold filled, after which the mounting cup 1021 is crimped onto the container 1002. This is not a precise operation and variation can occur from machine to machine, for example. The outcome could be variations in position of the actuator 1006, with the result that the sealing rim 1045 and tapered projection 1046 on the sealing finger 1004 will not match with the recesses 1047 and 1048, respectively, in the actuator 1006.

To avoid this problem, the embodiment of FIG. 17 includes a spring 1050. The spring extends between a recess 1052 in the mounting cup 1021 and a shoulder 1054 on the bottom of the actuator 1006. Spring 1050 biases the actuator 1006 outwardly until a projection 1056, formed on the actuator 1006, abuts a shoulder 1058, formed on the sleeve 1060, which acts as a stop. This is only given as an example of a stop; other ways of accomplishing this objective will be recognized by those of skill in the art. When an abutting relationship exists between the projection 1056 and the shoulder 1058, the sealing rim 1045 and tapered projection 1046 are in proper alignment with the recesses 1047 and 1048, respectively. In biasing the actuator 1006 outwardly, the downwardly extending projection 1007 may slide on the upwardly projecting stem 1026. However, the fit between those parts is such that good sealing takes place over a range sufficient to account for the differences resulting from variations in position resulting from the assembly of the mounting cup 1021 onto the container 1002. The length of the spring 1050 will depend on the spacing between the actuator 1006 and the recess 1052 in the mounting cup 1021. If, for example, the extension 709 of FIG. 15B is used, the spring 1050 will be longer.

Figure 18:
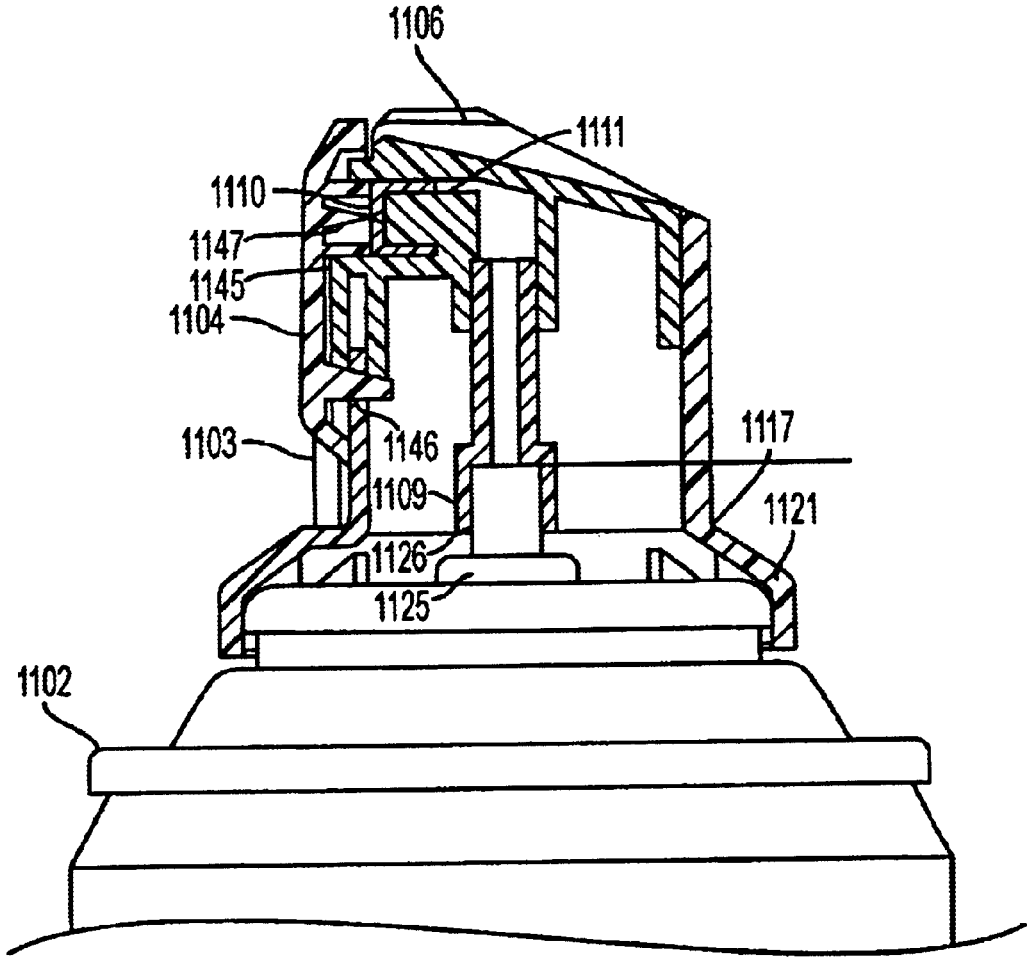
FIG. 18 is a side cross-sectional view of a further embodiment of the present invention.

FIG. 18 shows an aerosol container 1102 with a mounting cap 1117 which includes an embodiment of the nozzle closure of the present invention of the general nature shown in FIGS. 10, 11, 13, 14 and 15B. Mounting cap 1117 includes an upstanding wall 1103, an actuator 1106, and a sealing finger 1104. The top of the aerosol container 1102 includes a mounting cup 1121 which contains an aerosol valve 1125 with an upwardly projecting stem 1126, and has, as its purpose, mounting the aerosol valve 1125 and stem 1126 to the top of container 1102.

Mounting cap 1117 is press fit to container 1102. The construction and operation of sealing finger 1104 with its sealing rim 1145 and the optional tapered projection 1146 is as described in connection with FIGS. 10, 11, 13, 14 and 15B. In this embodiment, tapered projection 1146 is an optional feature. Sealing finger 1104 is shown in the closed position. Spray nozzle 1110 includes an orifice 1111 through which spray is dispensed. The sealing projection 1147 fits within the recess of sealing rim 1145, and when sealing finger 1104 is in the closed position, sealingly projection 1147 sealingly engages orifice 1111 and displaces any spray deposits that may have accumulated therein. If the user always closes sealing finger 1104, orifice 1111 should not become clogged. However, if the user falls to do so, then orifice 1111 may become clogged. In such a case, this embodiment provides a means of cleaning the clog to permit further dispensing.

Of course, it will be recognized by those skilled in the art that a variety of variations may be made in the construction of the above invention without departing from the claims. As such, the scope of the above invention is be limited only by the claims appended hereto.

What is claimed is:

1. An apparatus, comprising:

an aerosol dispenser, including:
- a closed container, and
- a mounting cup, attached to the closed container, having an aerosol valve with an upwardly projecting stem;

an actuator, including:
- a spray nozzle,
- an opening adjacent the spray nozzle,
- a recess below the opening, and
- a downwardly extending projection, in fluid communication with the spray nozzle, for sealingly engaging the upwardly projecting stem;

a member, including:

a wall, at least partially surrounding the actuator, having a spray opening, the spray opening being aligned with the spray nozzle when in a dispensing position, and a mounting cap, at the base of the wall, for press fitting onto the mounting cup; and a nozzle closure, including:

a first projection, fitting into the opening adjacent the spray nozzle, for sealing the spray nozzle, a hinge, mounted to the member, allowing pivotal movement of the nozzle closure from a closed position, at which the first projection fits into the opening adjacent the spray nozzle and the nozzle closure closes the spray opening, to an open position, at which the spray opening is open, and a second projection disposed within an inner recess of the first projection to sealingly engage an orifice of the spray nozzle when the nozzle closure is in the closed position.

2. The apparatus of claim 1, further including a third projection, between the hinge and the first projection, engaging the recess below the opening and preventing the actuation of the actuator when the nozzle closure is in the closed position.

3. The apparatus of claim 2, further including a spring, interposed between the actuator and the mounting, to outwarding bias the actuator to align the third projection with the recess below the opening.

4. The apparatus of claim 1, further including a spring interposed between the actuator and the mounting cup.

5. The apparatus of claim 4, wherein the spring outwardly biases the actuator to align the first projection with the opening adjacent the spray nozzle. below the opening.

6. The apparatus of claim 1, wherein the downwardly extending projection slides on the upwardly extending stem.

7. An apparatus, comprising:

a pump dispenser, including:

a closed container, and a pump, attached to the closed container, having an upwardly projecting stem;

an actuator, including:

a spray nozzle, an opening adjacent the spray nozzle, a recess below the opening, and a downwardly extending projection, in fluid communication with the spray nozzle, for sealingly engaging the upwardly projecting stem;

a member, including:

a wall, at least partially surrounding the actuator, having a spray opening, the spray opening being aligned with the spray nozzle when in a dispensing position, and a mounting cap, at the base of the wall, for attaching the member onto the a nozzle closure, including:

a first projection, fitting into the opening adjacent the spray nozzle, for sealing the spray nozzle, a hinge, mounted to the member, allowing pivotal movement of the nozzle closure from a closed position, at which the first projection fits into the opening adjacent the spray nozzle and the nozzle closure closes the spray opening, to an open position, at which the spray opening is open, and a second projection disposed within an inner recess of the first projection to sealingly engage an orifice of the spray nozzle when the nozzle closure is in the closed position.

8. The apparatus of claim 7, further including a third projection, between the hinge and the first projection, engaging the recess below the opening and preventing the actuation of the actuator when the nozzle closure is in the closed position.

9. The apparatus of claim 7, wherein the mounting cap is snapped onto the container.

10. The apparatus of claim 7, wherein the mounting cap is screwed onto the container.

11. An apparatus, comprising:

an actuator, including:

a spray nozzle, an opening adjacent the spray nozzle, a recess below the opening, and a downwardly extending projection, in fluid communication with the spray nozzle, for sealingly engaging an upwardly projecting stem;

a member, including:

a wall, at least partially surrounding the actuator, having a spray opening, the spray opening being aligned with the spray nozzle when in a dispensing position, and a mounting cap at the base of the wall; and a nozzle closure, including:

a first projection, fitting into the opening adjacent the spray nozzle, for sealing the spray nozzle, a hinge, mounted to the member, allowing pivotal movement of the nozzle closure from a closed position, at which the first projection fits into the opening adjacent the spray nozzle and the nozzle closure closes the spray opening, to an open position, at which the spray opening is open, and a second projection disposed within an inner recess of the first projection to sealingly engage an orifice of the spray nozzle when the nozzle closure is in the closed position.

12. The apparatus of claim 11, further including a third projection, between the hinge and the first projection, engaging the recess below the opening and preventing the actuation of the actuator when the nozzle closure is in the closed position.

13. The apparatus of claim 12, wherein the closed position defines a press fit between at least one of the nozzle closure and the wall, the first projection and the actuator, the second projection and the orifice of the spray nozzle, and the third projection and the actuator.

14. The apparatus of claim 11, wherein the hinge pivots about an axis parallel to a direction of actuation of the actuator.

15. The apparatus of claim 11, wherein the hinge pivots about an axis perpendicular to a direction of actuation of the actuator.

16. The apparatus of claim 11, wherein the spray opening is defined by two parallel edges, the edges having formed therein opposed slots, the hinge inserted and retained in the slots.

17. The apparatus of claim 11, wherein the first projection is an annular sealing rim.

18. The apparatus of claim 11, wherein the third projection is tapered.

* * * * *

UNITED STATES PATENT AND TRADEMARK OFFICE

CERTIFICATE OF CORRECTION

PATENT NO. : 6,817,488 B2
DATED : November 16, 2004
INVENTOR(S) : P. Meshberg

It is certified that error appears in the above-identified patent and that said Letters Patent is hereby corrected as shown below:

Column 9,
Line 34, replace "spray nozzle below the opening." with -- spray nozzle. --

Signed and Sealed this

Twenty-fourth Day of May, 2005

JON W. DUDAS
*Director of the United States Patent and Trademark Office*